US007637587B2

(12) United States Patent
Shamoun

(10) Patent No.: US 7,637,587 B2
(45) Date of Patent: Dec. 29, 2009

(54) SYSTEM AND METHOD FOR RELIABILITY TESTING AND TROUBLESHOOTING INKJET PRINTERS

(75) Inventor: Bassam Shamoun, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 226 days.

(21) Appl. No.: 11/846,770

(22) Filed: Aug. 29, 2007

(65) Prior Publication Data

US 2009/0058918 A1 Mar. 5, 2009

(51) Int. Cl.
*B41J 29/393* (2006.01)

(52) U.S. Cl. ..... 347/19

(58) Field of Classification Search ..... 347/19, 347/9–12, 15; 358/504
See application file for complete search history.

(56) References Cited

U.S. PATENT DOCUMENTS

| | | | |
|---|---|---|---|
| 4,571,601 | A | 2/1986 | Teshima |
| 4,987,043 | A | 1/1991 | Roosen et al. |
| 5,114,760 | A | 5/1992 | Takemura et al. |
| 5,177,627 | A | 1/1993 | Ishiwata et al. |
| 5,232,634 | A | 8/1993 | Sawada et al. |
| 5,232,781 | A | 8/1993 | Takemura et al. |
| 5,264,952 | A | 11/1993 | Fukutani et al. |
| 5,340,619 | A | 8/1994 | Chen et al. |
| 5,399,450 | A | 3/1995 | Matsushima et al. |
| 5,432,538 | A | 7/1995 | Carlotta |
| 5,552,192 | A | 9/1996 | Kashiwazaki et al. |
| 5,554,466 | A | 9/1996 | Matsushima et al. |
| 5,593,757 | A | 1/1997 | Kashiwazaki et al. |
| 5,626,994 | A | 5/1997 | Takayanagi et al. |
| 5,648,198 | A | 7/1997 | Shibata |
| 5,702,776 | A | 12/1997 | Hayase et al. |
| 5,705,302 | A | 1/1998 | Ohno et al. |
| 5,714,195 | A | 2/1998 | Shiba et al. |
| 5,716,739 | A | 2/1998 | Kashiwazaki et al. |
| 5,716,740 | A | 2/1998 | Shiba et al. |
| 5,726,724 | A | 3/1998 | Shirota et al. |
| 5,748,266 | A | 5/1998 | Kodate |
| 5,757,387 | A | 5/1998 | Manduley |
| 5,811,209 | A | 9/1998 | Eida et al. |
| 5,817,441 | A | 10/1998 | Iwata et al. |
| 5,831,704 | A | 11/1998 | Yamada et al. |
| 5,847,735 | A | 12/1998 | Betschon |
| 5,880,799 | A | 3/1999 | Inoue et al. |
| 5,895,692 | A | 4/1999 | Shirasaki et al. |
| 5,916,713 | A | 6/1999 | Ochiai et al. |
| 5,916,735 | A | 6/1999 | Nakashima et al. |

(Continued)

FOREIGN PATENT DOCUMENTS

| | | |
|---|---|---|
| DE | 1 218 473 | 6/1966 |

(Continued)

*Primary Examiner*—Lamson D Nguyen
(74) *Attorney, Agent, or Firm*—Dugan & Dugan, PC

(57) ABSTRACT

Systems, methods and apparatus are provided for reliability testing an inkjet printing system. The invention includes a testing interface, a print head coupled to the testing interface, printer control electronics coupled to the testing interface and coupled to the print head via the testing interface, the printer control electronics adapted to transmit a firing voltage signal through the testing interface to the print head, and a measurement apparatus coupled to the testing interface. The testing interface includes an input path for receiving the firing voltage signal from the printer control electronics, the input path splitting into a first path coupled to the print head and a second path coupled to the measurement apparatus. Numerous other aspects are disclosed.

14 Claims, 8 Drawing Sheets

U.S. PATENT DOCUMENTS 5,922,401 A 7/1999 Kashiwazaki et al.
5,948,576 A 9/1999 Shirota et al.
5,948,577 A 9/1999 Nakazawa et al.
5,956,063 A 9/1999 Yokoi et al.
5,962,581 A 10/1999 Hayase et al.
5,968,688 A 10/1999 Masuda et al.
5,969,780 A 10/1999 Matsumoto et al.
5,984,470 A 11/1999 Sakino et al.
5,989,757 A 11/1999 Satoi
6,013,415 A 1/2000 Sakurai et al.
6,025,898 A 2/2000 Kashiwazaki et al.
6,025,899 A 2/2000 Fukunaga et al.
6,042,974 A 3/2000 Iwata et al.
6,063,527 A 5/2000 Nishikawa et al.
6,066,357 A 5/2000 Tang et al.
6,071,989 A 6/2000 Sieber et al.
6,078,377 A 6/2000 Tomono et al.
6,087,196 A 7/2000 Sturm et al.
6,134,059 A 10/2000 Shirota et al.
6,140,988 A 10/2000 Yamada
6,142,604 A 11/2000 Kanda et al.
6,145,981 A 11/2000 Akahira et al.
6,149,257 A 11/2000 Yanaka et al.
6,153,711 A 11/2000 Towns et al.
6,154,227 A 11/2000 Lund
6,158,858 A 12/2000 Fujiike et al.
6,162,569 A 12/2000 Nakashima et al.
6,196,663 B1 3/2001 Wetchler et al.
6,211,347 B1 4/2001 Sieber et al.
6,224,205 B1 5/2001 Akahira et al.
6,226,067 B1 5/2001 Nishiguchi et al.
6,228,435 B1 5/2001 Yoshikawa et al.
6,234,626 B1 5/2001 Axtell et al.
6,242,139 B1 6/2001 Hedrick et al.
6,244,702 B1 6/2001 Sakino et al.
6,264,322 B1 7/2001 Axtell et al.
6,270,930 B1 8/2001 Okabe
6,271,902 B1 8/2001 Ogura et al.
6,277,529 B1 8/2001 Marumoto et al.
6,281,960 B1 8/2001 Kishimoto et al.
6,312,771 B1 11/2001 Kashiwazaki et al.
6,322,936 B1 11/2001 Nishikawa et al.
6,323,921 B1 11/2001 Kurauchi et al.
6,331,384 B1 12/2001 Satoi
6,341,840 B1 1/2002 van Doorn et al.
6,344,301 B1 2/2002 Akutsu et al.
6,356,357 B1 3/2002 Anderson et al.
6,358,602 B1 3/2002 Horiuchi et al.
6,367,908 B1 4/2002 Serra et al.
6,384,528 B1 5/2002 Friend et al.
6,384,529 B2 5/2002 Tang et al.
6,386,675 B2 5/2002 Wilson et al.
6,392,728 B2 5/2002 Tanaka et al.
6,392,729 B1 5/2002 Izumi et al.
6,399,257 B1 6/2002 Shirota et al.
6,417,908 B2 7/2002 Nishiguchi et al.
6,424,393 B1 7/2002 Hirata et al.
6,424,397 B1 7/2002 Kuo
6,426,166 B2 7/2002 Nishikawa et al.
6,428,135 B1 8/2002 Lubinsky et al.
6,428,151 B1 8/2002 Yi et al.
6,429,601 B1 8/2002 Friend et al.
6,429,916 B1 8/2002 Nakata et al.
6,433,852 B1 8/2002 Sonoda et al.
6,450,635 B1 9/2002 Okabe et al.
6,455,208 B1 9/2002 Yamashiki et al.
6,462,798 B1 10/2002 Kim et al.
6,464,329 B1 10/2002 Koitabashi et al.
6,464,331 B1 10/2002 Van Doorn et al.
6,468,702 B1 10/2002 Yi et al.
6,475,271 B2 11/2002 Lin
6,476,888 B2 11/2002 Yamanashi
6,480,253 B1 11/2002 Shigeta et al.
6,498,049 B1 12/2002 Friend et al.
6,508,533 B2 1/2003 Tsujimoto et al.
6,518,700 B1 2/2003 Friend et al.
6,557,984 B2 5/2003 Tanaka et al.
6,569,706 B2 5/2003 Pakbaz et al.
6,580,212 B2 6/2003 Friend
6,627,364 B2 9/2003 Kiguchi et al.
6,630,274 B1 10/2003 Kiguchi et al.
6,667,795 B2 12/2003 Shigemura
6,686,104 B1 2/2004 Shiba et al.
6,692,983 B1 2/2004 Chen et al.
6,693,611 B1 2/2004 Burroughes
6,695,905 B2 2/2004 Rozumek et al.
6,698,866 B2 3/2004 Ward et al.
6,705,694 B1 3/2004 Barbour et al.
6,738,113 B2 5/2004 Yu et al.
6,762,234 B2 7/2004 Grizzi
7,413,272 B2 5/2006 Shamoun et al.
7,271,824 B2 9/2007 Omori et al.
2001/0012596 A1 8/2001 Kunimoto et al.
2002/0054197 A1 5/2002 Okada et al.
2002/0081376 A1 6/2002 Yonehara
2002/0128515 A1 9/2002 Ishida et al.
2003/0025446 A1 2/2003 Lin et al.
2003/0030715 A1 2/2003 Cheng et al.
2003/0039803 A1 2/2003 Burroughes
2003/0076454 A1 4/2003 Burroughes
2003/0117455 A1 6/2003 Bruch et al.
2003/0118921 A1 6/2003 Chen et al.
2003/0171059 A1 9/2003 Kawase et al.
2003/0189604 A1 10/2003 Bae et al.
2003/0218645 A1 11/2003 Dings et al.
2003/0222927 A1 12/2003 Koyama
2003/0224621 A1 12/2003 Ostergard et al.
2004/0008243 A1 1/2004 Sekiya
2004/0018305 A1 1/2004 Pagano et al.
2004/0023567 A1 2/2004 Koyama et al.
2004/0041155 A1 3/2004 Grzzi et al.
2004/0075383 A1 4/2004 Endo et al.
2004/0075789 A1 4/2004 Wang
2004/0086631 A1 5/2004 Han et al.
2004/0094768 A1 5/2004 Yu et al.
2004/0097101 A1 5/2004 Kwong et al.
2004/0097699 A1 5/2004 Holmes et al.
2004/0109051 A1 6/2004 Bright et al.
2004/0125181 A1 7/2004 Nakamura
2004/0218002 A1 11/2004 Nakamura
2005/0041073 A1 2/2005 Fontaine et al.
2005/0057599 A1 3/2005 Takenaka et al.
2005/0083364 A1 4/2005 Billow
2006/0092436 A1 5/2006 White et al.
2006/0109290 A1 5/2006 Shamoun et al.
2006/0109296 A1 5/2006 Shamoun et al.
2007/0042113 A1 2/2007 Ji et al.
2008/0211847 A1 9/2008 Shamoun

FOREIGN PATENT DOCUMENTS

EP 0 675 385 A1 10/1995
EP 1 106 360 A1 6/2001
EP 1 557 270 A1 7/2005
JP 59-075205 4/1984
JP 61-245106 10/1986
JP 63-235901 9/1988
JP 63-294503 12/1988
JP 01-277802 11/1989
JP 02-173703 7/1990
JP 02-173704 7/1990
JP 07-198924 8/1995
JP 08-160219 6/1996
JP 10-039130 2/1998

| | | | | | |
|---|---|---|---|---|---|
| JP | 10-073813 | 3/1998 | JP | 2004-077681 | 3/2004 |
| JP | 2002-277622 | 9/2002 | WO | WO 02/14076 A1 | 2/2002 |
| JP | 2003-303544 | 10/2003 | WO | WO 03/045697 A1 | 6/2003 |

SYSTEM AND METHOD FOR RELIABILITY TESTING AND TROUBLESHOOTING INKJET PRINTERS

CROSS REFERENCE TO RELATED APPLICATIONS

The present application is related to U.S. patent application Ser. No. 11/061,120, filed on Feb. 18, 2005 and entitled "METHODS AND APPARATUS FOR PRECISION CONTROL OF PRINT HEAD ASSEMBLIES" which is hereby incorporated by reference herein in its entirety.

The present application is also related to U.S. patent application Ser. No. 11/238,637, filed on Sep. 29, 2005 and entitled "METHODS AND APPARATUS FOR A HIGH RESOLUTION INKJET FIRE PULSE GENERATOR" which is hereby incorporated by reference herein in its entirety.

FIELD OF THE INVENTION

The present invention relates generally to systems for manufacturing color filters for flat panel displays, and is more particularly concerned with apparatus and methods for testing and maintaining such systems.

BACKGROUND OF THE INVENTION

The flat panel display industry has been attempting to employ inkjet printing to manufacture display devices, in particular, color filters. When inkjet printing techniques are applied in high throughput manufacturing, it is beneficial to maximize system reliability while minimizing system down time by rapid troubleshooting. System failures can arise in one or more printing channels due to clogging, electronics malfunction and variation of printhead parameters. In the case of electronics malfunction and variation of printhead parameters, it is cumbersome to manually examine signals to isolate the location and nature of a specific failure. Accordingly, apparatus and methods are needed to efficiently acquire data, test reliability and troubleshoot failures in inkjet printer systems.

SUMMARY OF THE INVENTION

In some aspects, the present invention provides a method for reliability testing an inkjet printing system including a print head having a capacitance and printer control electronics adapted to transmit a firing voltage signal to activate the print head. The method includes pre-calibrating a relationship between a capacitance of the print head and a measured voltage value of the firing voltage signal; measuring an actual firing voltage signal; determining the value of the print head capacitance by interpolation based on the measured firing voltage signal and the pre-calibrated relationship between the print head capacitance and measured voltage; and calculating a voltage at the print head based on the determined print head capacitance. Operability of the print head is then ascertainable based on the values of the print head capacitance and calculated print head voltage.

In some other aspects, the present invention provides a method that includes measuring a capacitance of printer control electronics ($C_{pce}$) and a test capacitance of a known value ($C_{known}$) once per channel; measuring a per-channel voltage ($V_{no\ load}$) at a measurement apparatus used to measure $C_{pce}$ and $C_{known}$ without a capacitive load; measuring a per-channel voltage ($V_{known\ load}$) at the measurement apparatus used to measure $C_{pce}$ and $C_{known}$ with a known capacitive load coupled to a testing interface; measuring a per-channel voltage ($V_{unknown\ load}$) at the measurement apparatus used to measure $C_{pce}$ and $C_{known}$ with an unknown capacitive load coupled to the testing interface; calculating a data acquisition capacitance ($C_{DAQ}$) based on the measured voltages; calculating a print head capacitance ($C_{head}$) based on a slew-rate ratio; and reconstructing a fire pulse voltage signal for each print head channel based on the ratio of $V_{known\ load}$ to $V_{unknown\ load}$, $C_{DAQ}$, $V_{no\ load}$, $C_{pce}$ and $C_{known}$.

In yet other aspects, the present invention provides a system for reliability testing an inkjet printing system. The system for reliability testing includes a testing interface, a print head coupled to the testing interface, printer control electronics coupled to the testing interface and coupled to the print head via the testing interface, the printer control electronics adapted to transmit a firing voltage signal through the testing interface to the print head, and a measurement apparatus coupled to the testing interface. The testing interface includes an input path for receiving the firing voltage signal from the printer control electronics, the input path splitting into a first path coupled to the print head and a second path coupled to the measurement apparatus.

In still yet other aspects, the present invention provides an apparatus for testing an inkjet printing system. The apparatus includes a test interface adapted to be coupled to a print head and to a print control circuit, wherein the print control circuit is coupled to the print head via the test interface and is adapted to transmit a firing signal through the test interface to the print head; and a measurement circuit coupled to the test interface. The test interface includes an input path for receiving the firing signal from the print control circuit, the input path being split into a first path coupled to the print head and a second path coupled to the measurement circuit.

Other features and aspects of the present invention will become more fully apparent from the following detailed description, the appended claims and the accompanying drawings.

DETAILED DESCRIPTION

In an inkjet printer, an inkjet printer control system operates one or more inkjet print heads to dispense ink (or other fluid) onto a substrate. The inkjet print heads typically include multiple separately-controllable nozzles which each dispense drops upon being activated. The control path for each nozzle comprises a channel along which voltage signals may be propagated for nozzle activation. For example, some print heads include piezoelectric transducers (PZTs) coupled to each nozzle that expand and contract to release a drop of ink through an opening in response to a voltage pulse. When a channel is functioning properly, the amplitude of a voltage pulse measured across the channel is well defined; this allows the proper functioning of the channel to be tested through measurement of the channel voltage.

According to some embodiments, the present invention provides a system and method for determining whether each channel of a print head is functioning properly based on a fire pulse voltage measured across each respective channel. In some embodiments, a measurement apparatus acquires voltage data from the multiple print head channels via a testing interface that modifies the voltage signal to match requirements of a measurement apparatus. Since the measurement apparatus as well as the testing interface introduce their own capacitance to the printing system to which it is applied (the combined capacitance of the measurement apparatus, the printer control electronics, and testing interface is termed the 'data acquisition capacitance' ($C_{DAQ}$)), the voltages that are recorded by the measurement apparatus reflect contributions from its own capacitance in addition to the capacitance of the print head channels. For this reason, the recorded voltages do not reflect accurate measurements of the channel voltages. To obtain accurate channel voltages, each contribution to the total capacitance (hereinafter '$C_{tot}$'), that is, the sum of the capacitance of the data acquisition system ($C_{DAQ}$), and the capacitance of the print head channel (hereinafter '$C_{head}$'), is isolated and determined separately.

In some embodiments of the present invention, the channel capacitance $C_{head}$ is determined based on the measured voltage (hereinafter 'V2'). However, the relationship between $C_{head}$ and V2 is usually not linear. Thus, in some embodiments, the present invention provides a method of calibrating numerous per channel capacitance $C_{head}$ values with measured voltage values V2 such that unknown channel capacitances can be interpolated from calibrated values. The per channel voltage V1 may then be ascertained based on the measured voltage V2, and the separately determined capacitances $C_{head}$ and $C_{tot}$.

System Overview

Figure 1:
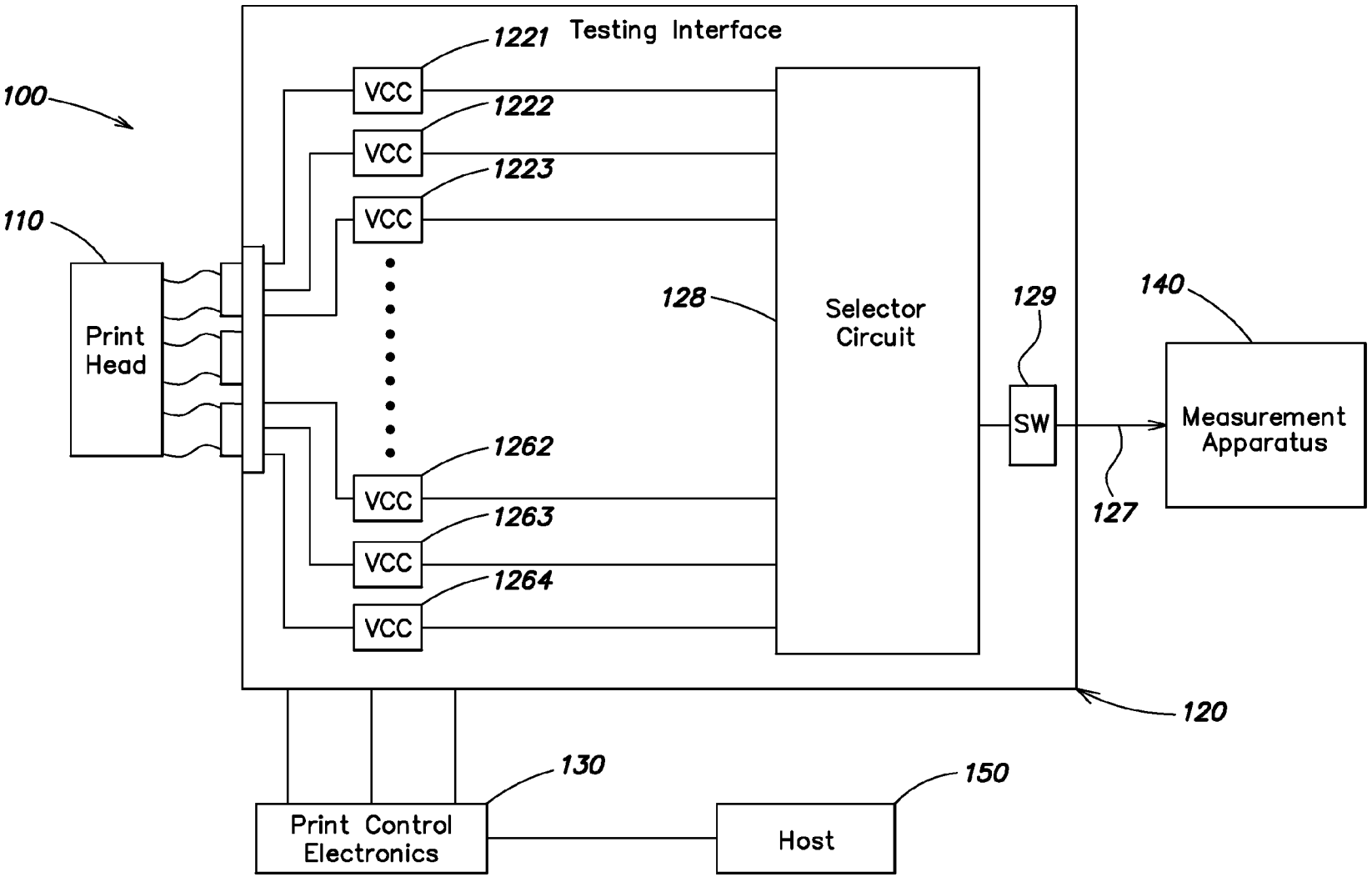
FIG. 1 is a schematic illustration of an example embodiment of a system for testing the reliability of an inkjet print system according to the present invention.

Turning to FIG. 1, a schematic illustration of an example embodiment of a system 100 for testing the reliability of an inkjet printing system is provided. In system 100, a print head 110 to be tested is coupled to a testing interface 120 (described further below). The print head 110 may include a number of control channels coupled to actuators for controllably dispensing ink through nozzles on the print head (not shown). An example of a suitable commercially available print head that may be used in the context of the present invention is the model SX-128, 128-Channel Jetting Assembly manufactured by Spectra, Inc. of Lebanon, N.H. This particular jetting assembly includes two electrically independent piezoelectric slices, each with sixty-four addressable channels, which are combined to provide a total of 128 jets. The nozzles are arranged in a single line, at a 0.020" distance between nozzles. The nozzles are designed to dispense drops from 10 to 12 picoliters but may be adapted to dispense from 10 to 30 picoliters. However, it is emphasized that other print heads may also be used and tested in accordance with the inventive principles set forth herein.

Printer control electronics 130 are coupled to the print head 110 through the testing interface 120. The printer control electronics 130 includes logic, communication, and memory devices configured to control the operation of the print head 110. The print control electronics 130 may be implemented using one or more field programmable gate arrays (FPGA) or other similar devices. In some embodiments, discrete components may alternatively or additionally be used. In particular, the printer control electronics 130 may include one or more drivers that may each include logic to transmit control signals (e.g., fire pulse signals) to one or more print heads e.g., print head 110. Each driver of the printer control electronics 130 is adapted to transmit signals on multiple channels so that each actuator corresponding to each nozzle of the print head can be individually and independently actuated. For example, if the print head 110 comprises a 128-channel device, then the driver is adapted to address control signals to each of the 128 channels by separate connections, a multiplexing arrangement or any other electronic addressing mechanism.

The print control electronics 130 may be coupled to a power supply (not shown) so as to be able to generate relatively high voltage firing pulses to trigger the nozzles of the print head 110 to "jet" ink. In some embodiments, the power supply may be a high voltage negative power supply adapted to generate signals having amplitudes of approximately 140 volts or more. Other voltages may be used. The print control electronics 130 may send firing pulse voltage signals with specific amplitudes and durations so as to cause the nozzles of the print head 110 to dispense fluid drops of specific drop sizes as described, for example, in previously incorporated U.S. patent application Ser. No. 11/061,120. The print control electronics 130 may additionally be coupled to a host computer 150 for receiving data or instructions for generating the firing pulses.

As shown in FIG. 1, firing voltage signals generated by the print control electronics 130 are transmitted through the testing interface 120, within which the voltage signals are split along two separate connection paths, one leading to the print head 110, and another leading to one of a number of voltage compensator circuits 1221, 1222, 1223 . . . 1262, 1263, 1264 that lead downstream to a measurement apparatus 140. The number of compensator circuits corresponds to the number of channels to be tested during a testing operation; this may comprise all of the print head channels, or a portion thereof, such as half (e.g., 64 channels in the case of a 128-channel print head device). In the example embodiment shown in FIG. 1, there are sixty-four (64) compensator circuits 1221, 1222, 1223 . . . 1262, 1263, 1264 which collectively receive the voltage signals for driving one of the two sides of a 128-channel print head. It is noted that the testing interface 120 and/or the measurement apparatus 140 may be embodied as sub-components of the print control electronics 130, and thus may comprise on-board components of an inkjet printing system as shown below in FIG. 8. In alternative embodiments, the testing interface 120 and measurement apparatus 140 may comprise off-board components which may be operatively coupled to the inkjet printing system, i.e., the print head 110 and the print control electronics 130 on an as-needed basis.

Figure 8:
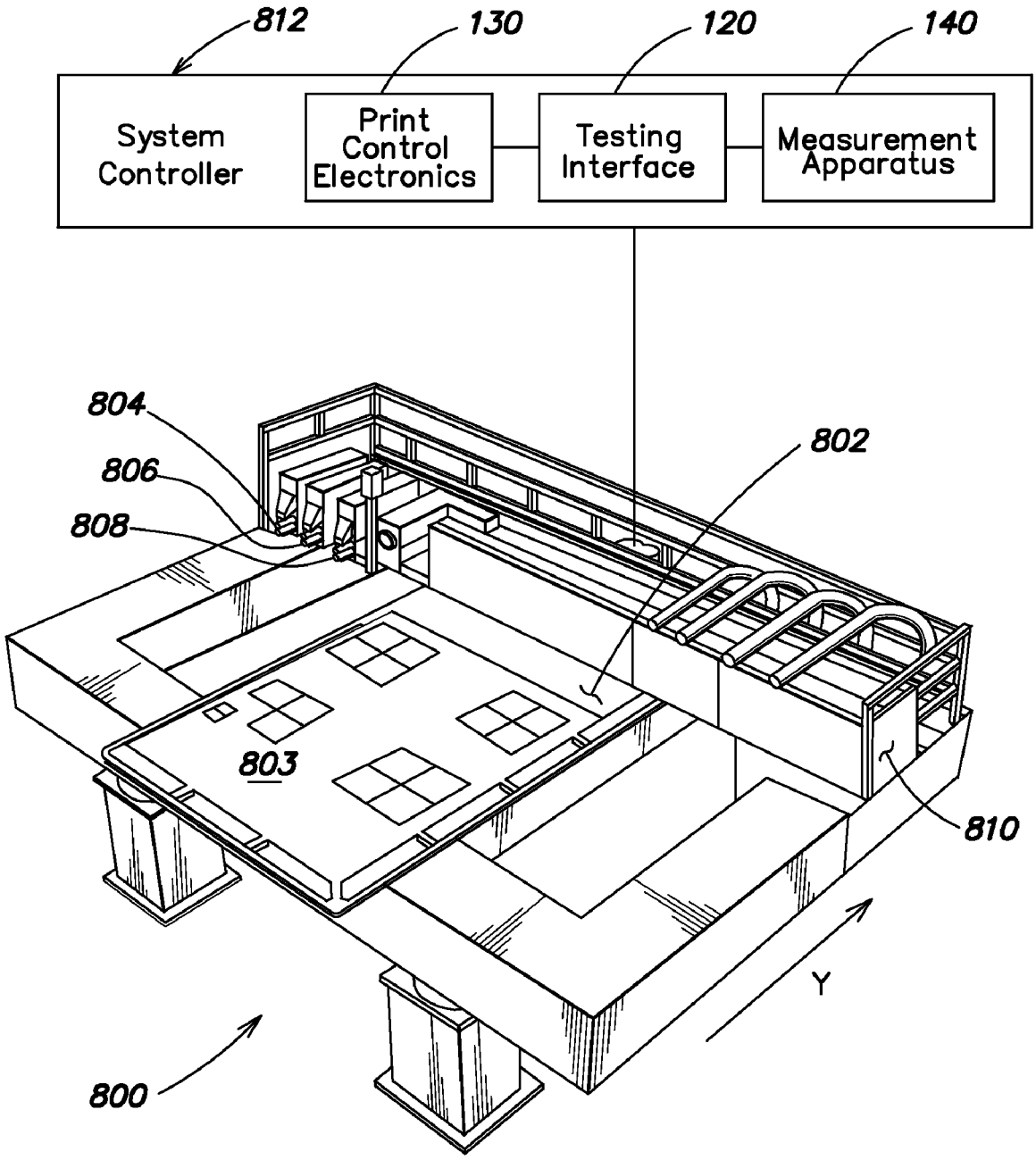
FIG. 8 is a perspective view of an exemplary inkjet printing system that includes a system for reliability testing according to the present invention.

FIG. 8 is a perspective view of an exemplary embodiment of an inkjet printing system that incorporates a testing interface 120 and measurement apparatus 140 according to an embodiment of the present invention. The inkjet printing system 800 includes a support stage 802 adapted to support and transport a substrate 803 upon which ink is to be printed using a plurality of inkjet print heads 804, 806, 808. As shown, the inkjet print heads 804, 806, 808 may be positioned on a bridge 810 aligned perpendicularly to the direction (Y-direction) in which the substrate 803 is transported by the support stage 802. The inkjet printing system 800 also includes a system controller 812 adapted to control and direct the components of the system 800 including the support stage 802, and inkjet print heads 804, 806, 808. The system controller 812 may comprise sub-components (e.g., electronic control units, application specific integrated circuits (ASICs), field-programmable gate arrays (FPGAs)) adapted to control and/or perform specific tasks. For example, in one or more embodiments, the system controller 812 may include print control electronics 130, the testing interface 120 and the measurement apparatus 140 according to the invention. In this manner, the inventive reliability testing system may be incorporated as an on-board component of the inkjet printing system 800. In the embodiment shown in FIG. 8, the print control electronics 130, testing interface 120 and measurement apparatus 140 are depicted as discrete components, but in alternative embodiments, they may be integrated in various ways. For example, the print control electronics 130 may incorporate the testing interface 120 as a and the measurement apparatus 140 as sub-components, or alternatively, the measurement apparatus 140 may be discrete from the print control electronics 130 and may include the testing interface 120.

Figure 2:
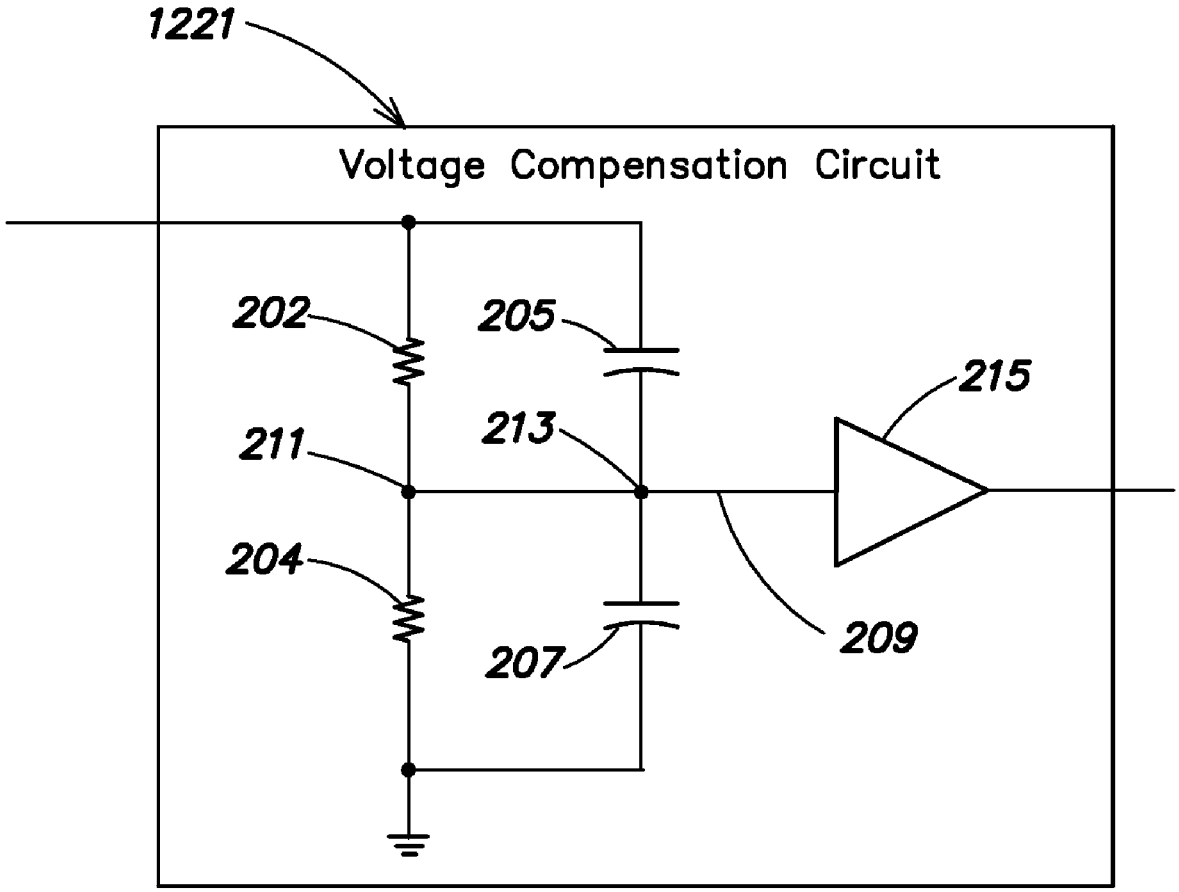
FIG. 2 is a schematic illustration of an exemplary voltage compensator circuit according to the present invention.

FIG. 2 is a schematic illustration of an exemplary voltage compensator circuit according to some embodiments of the present invention. The voltage compensator circuit 1221 includes two resistors 202, 204 connected in series; the resistors 202, 204 are connected in parallel with two capacitors 205, 207 connected in series. Resistor 202 (R1) is coupled at a first end to the printer control electronics from which it receives a firing voltage signal and is coupled at a second end to resistor 204. Resistor 204 (R2) is coupled at a first end to resistor 202 and at a second end to a ground connection. Similarly, capacitor 205 is coupled at a first end to the printer control electronics and is coupled at a second end to capacitor 207. Capacitor 207 is coupled at a first end to capacitor 205 and is coupled at a second end to a ground connection.

An output path 209 taps node 211 between resistors 202, 204 and also taps node 213 between capacitors 205, 207 such that the resistors act as a voltage divider to lower the firing voltage signal to match input requirements of the measurement apparatus employed. Example values for resistors 202, 204 are 10 Mega-ohms and 200 Kilo-ohms, respectively, which provides a large amount of attenuation. Other resistor values can also be used. In operation, when a firing voltage signal is transmitted, a large proportion of current from the signal flows through the capacitors 205, 207 which then become charged. The capacitors 205, 207 then act as voltage sources with respect to resistors 202, 204 and aid in reconstructing the firing voltage waveform. Example values for capacitors 205, 207 are 10 picofarads (10 pF) and 500 picofarads (500 pF), respectively.

The output path 209 leads from nodes 211, 213 to a buffer 215 which may comprise an operational amplifier or similar device having high input impedance and low output impedance to improve measurement accuracy. The output from the buffer 215 represents the output of the compensator circuit 1221.

Referring again to FIG. 1, outputs from each channel, i.e., each compensator circuit 1221, 1222, 1223 . . . 1262, 1263, 1264, are fed into a selector circuit 128 that is adapted to select the output of one of the compensator circuits for further transmission to the measurement apparatus. The selector circuit 128 may comprise an n-bit multiplexer, for example, where the number of bits corresponds to the number of input channels. Other devices or components may also be used, such as a plurality of multiplexers that include fewer channels. The selector circuit 128 includes selector inputs (not shown) that allow a particular channel to be controllably selected for output from the selection circuit along output path 127.

The output path 127 from the selector circuit 128 leads to a measurement apparatus 140 which is adapted to accurately measure the voltage signal supplied to it along path 129. An example of a suitable commercially available measurement apparatus that may be used in the context of the present invention is the PXI-6239 Multifunction Data Acquisition (DAQ) device manufactured by National Instruments Inc. of Austin, Tex. The measurement apparatus 140 may additionally comprise or be coupled to a computer or control electronics that allow user control of the measurement apparatus. The measurement apparatus may be coupled via a TTL or other type of connection to a switching device 129 situated within (as shown) or coupled the testing interface 120. By activating the switching device 129, the testing interface 120 can be disconnected via the measurement apparatus when it is desired to stop testing operations.

As can be seen from FIG. 1, the total current delivered by the printer control electronics 130 is divided between the printer head path and data acquisition path. The added capacitance of the testing interface and measurement apparatus changes the firing voltage signal characteristics in terms of both slew rate and amplitude. The slew rate can be expressed as follows:

$$dV=(1/C)*I*dt \quad (1)$$

From this equation, it can be seen that the slew rate of a signal is inversely proportional to capacitance along the signal path. Taking V1 to be the voltage drop across a print head channel without a contribution from the data acquisition path and V2 to be the voltage drop across a the print head channel including the contribution from the data acquisition path, the ratio of V1 to V2 can be expressed according to equation (2) as:

$$V1/V2=C_{tot}/C_{head}=a1/a2 \quad (2),$$

where a1, a2 represent respective slew rates of voltage signals V1, V2.

Figure 3:
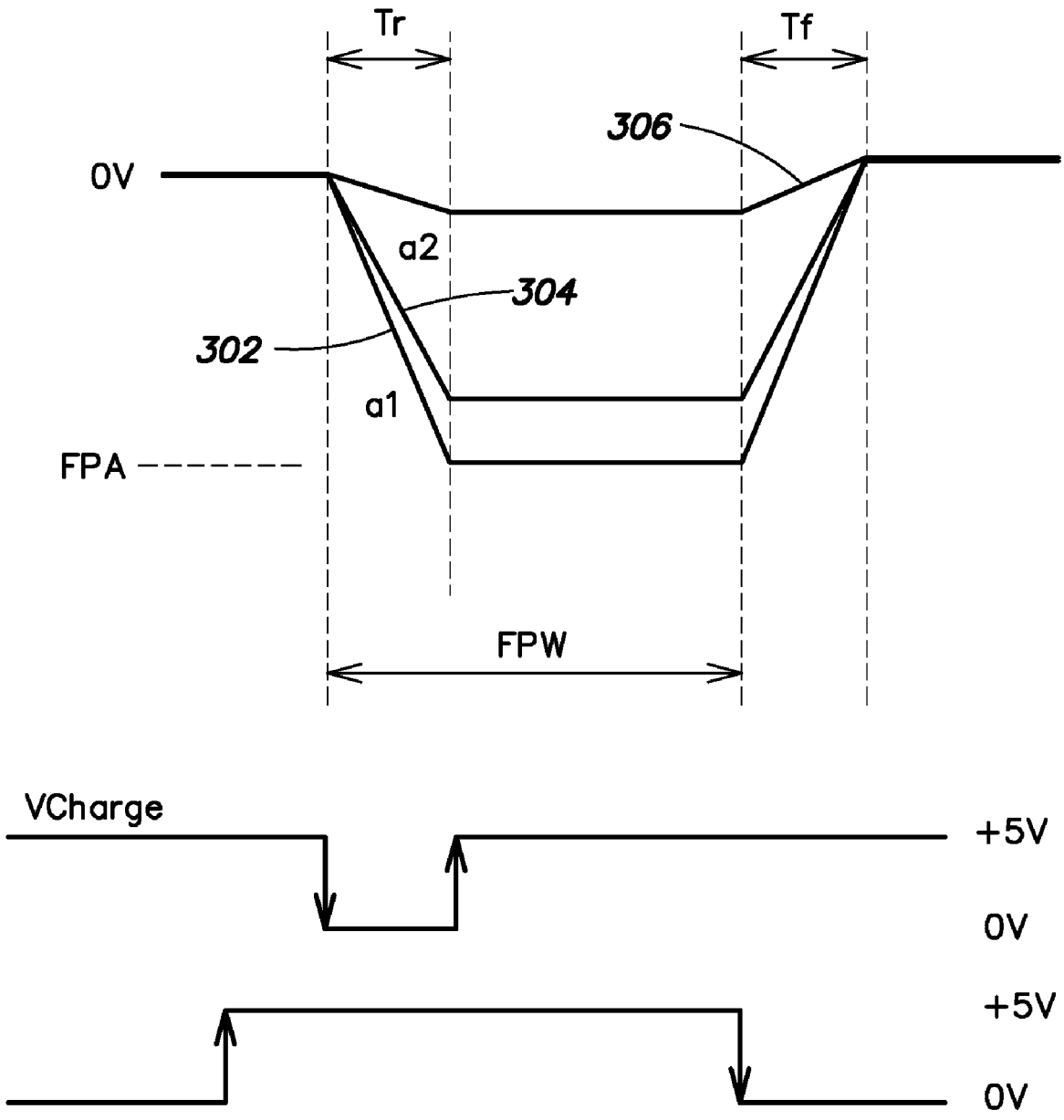
FIG. 3 is a graph showing representative voltage pulses of V1 and V2 without attenuation and a measured pulse of V2 with attenuation provided by the testing interface.

FIG. 3 is a graph showing actual voltages pulses of V1 and V2 and a measured pulse of V2 with attenuation provided by the testing interface. Curve 302 shows a pulse of V1, showing the relatively high slew rate (a1) and pulse amplitude of a voltage signal across a print head without the contribution of capacitance from the data acquisition path. Curve 304 illustrates the effect of capacitance along the data acquisition path (without attenuation from the testing interface), which reduces the slew rate (a2) and the pulse amplitude. Curve 306 shows a representative voltage pulse as measured by the measurement apparatus which illustrates the additional effects of attenuation produced by the compensator circuit of the testing interface.

As indicated, the measured voltage pulse shown in curve 306 varies considerably from curve 302 which it is meant to reproduce. If the print head capacitance $C_{head}$ were known beforehand, it would be a trivial matter to reconstruct V1 from V2 as measured (i.e., from equation (2)); however, the print head capacitance varies from one channel to another within a print head, and between different heads, resulting in a non-linear relationship between V2 and $C_{head}$. Owing to this non-linear relationship, $C_{head}$ typically cannot be determined by linear scaling.

Overall Reliability Testing Method

Figure 4:
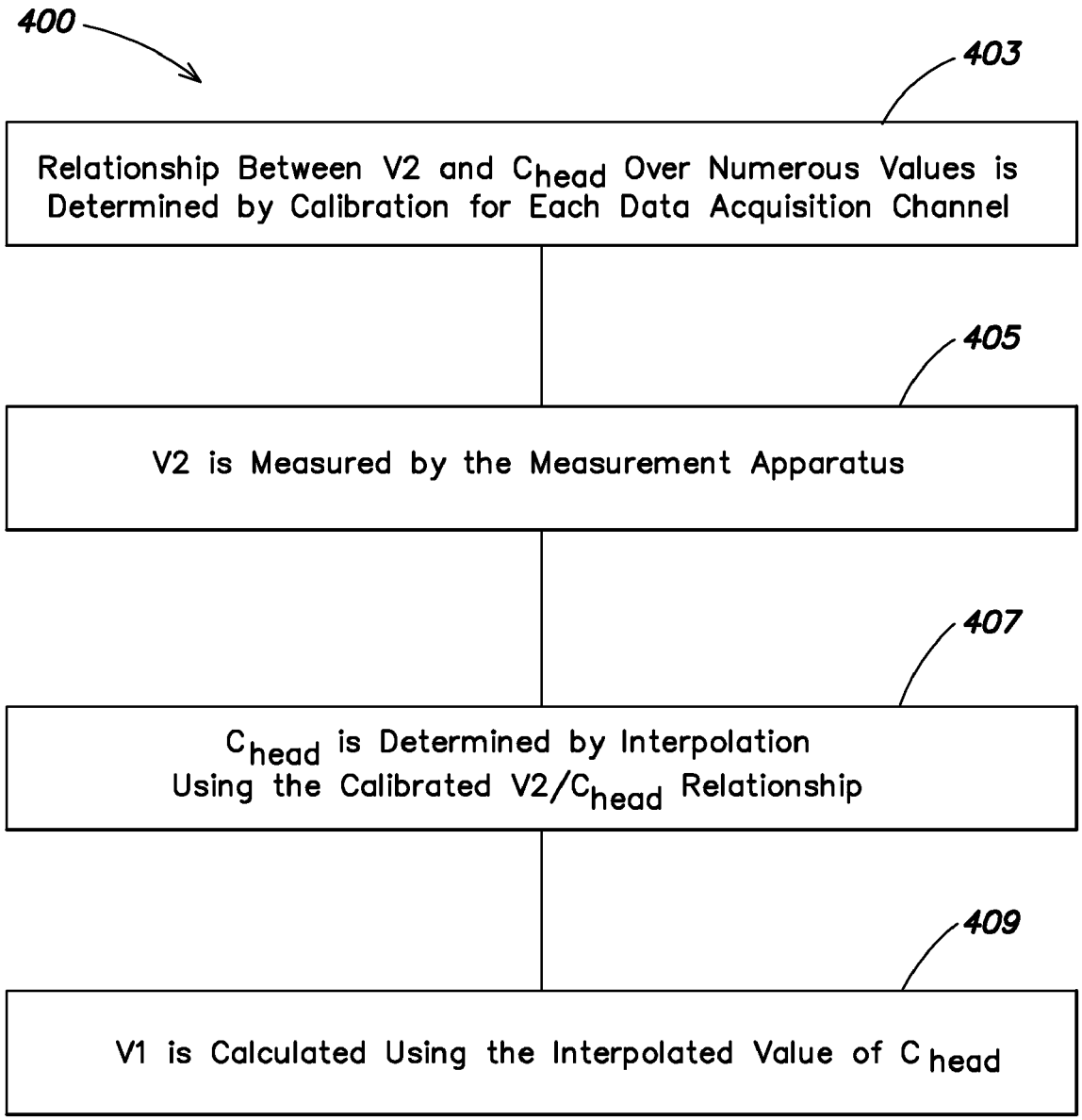
FIG. 4 is a flowchart of a method of testing the reliability of a print head channel according to the present invention.
Figure 5:
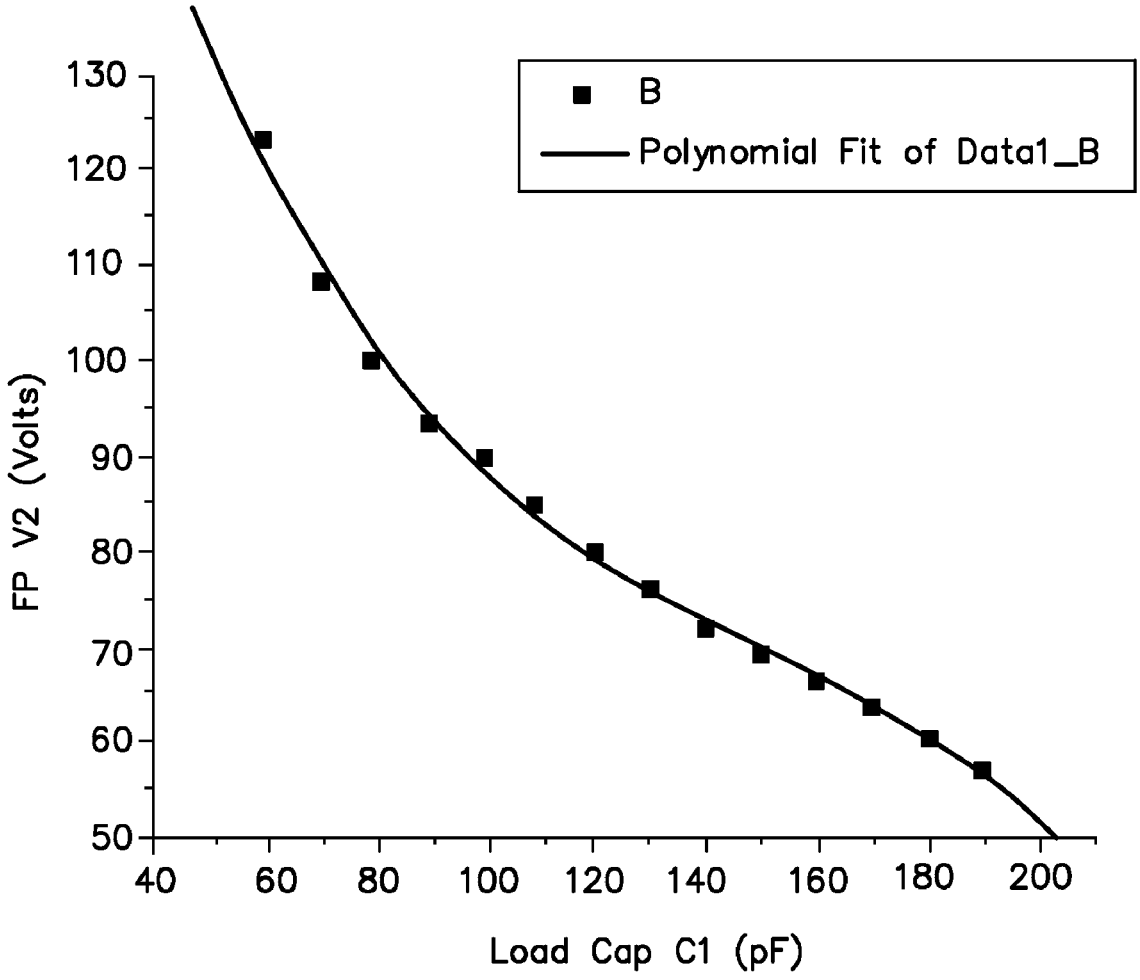
FIG. 5 is a graph of an example nonlinear relationship between V2 and $C_{head}$ for a particular channel.

Referring to the flowchart of FIG. 4, a method 400 of testing the reliability of a print head channel is depicted. In operation, in step 403, a calibration process is performed in which the relationship between the value of $C_{head}$ and voltage V2 is determined over a range of values of $C_{head}$ for each data acquisition channel. FIG. 5 is a graph of an example nonlinear relationship between V2 and $C_{head}$ for a particular channel, including a curve fit between obtained data points. Details of the calibration process are discussed below with reference to FIGS. 6, 7A, 7B and 7C. In step 405, in a specific testing operation, V2 is measured across a data acquisition channel using the measurement apparatus. In step 407, the print head capacitance $C_{head}$ is determined by interpolation using the calibrated $V2/C_{head}$ relationship, i.e., by finding the point at which V2 lies on the $V2/C_{head}$ curve and ascertaining the $C_{head}$ value at this data point. Once $C_{head}$ has been determined, the reconstructed print head voltage V1 is calculated in step 409 using equation (2), i.e., $V1=V2*C_{head}/C_{head}+C_{DAQ}$.

Exemplary Calibration Method

Figure 6:
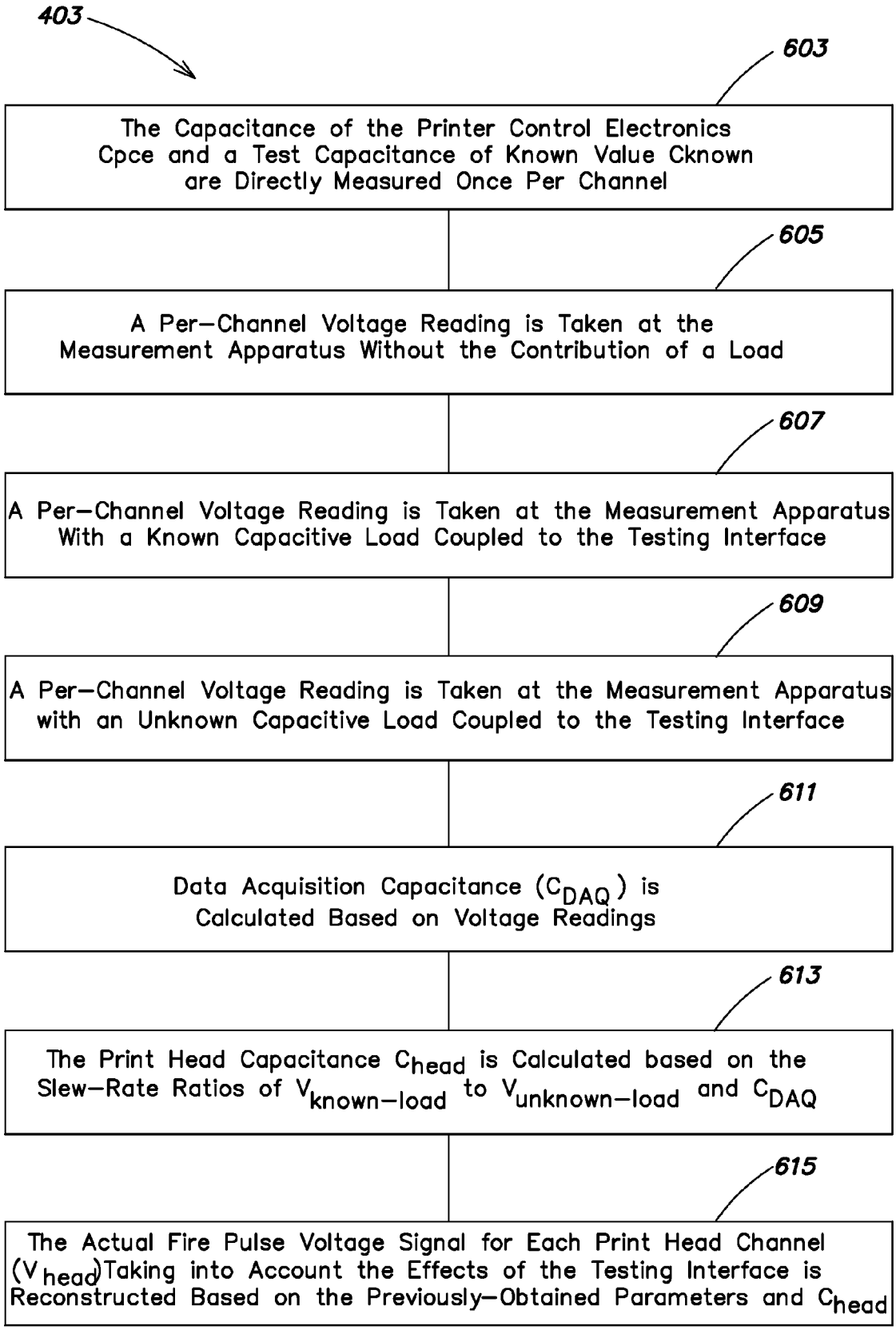
FIG. 6 is a flow chart of an exemplary calibration method that may be used in the context of the reliability testing method of the present invention.
Figure 7A:
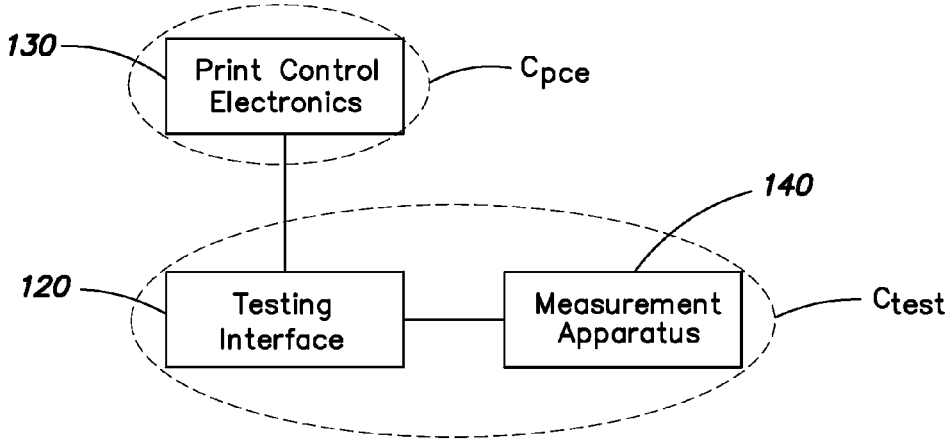
FIGS. 7A-C are schematic illustrations showing the capacitive contributions of elements in the reliability testing system used in the calibration process shown in FIG. 6.
Figure 7B:
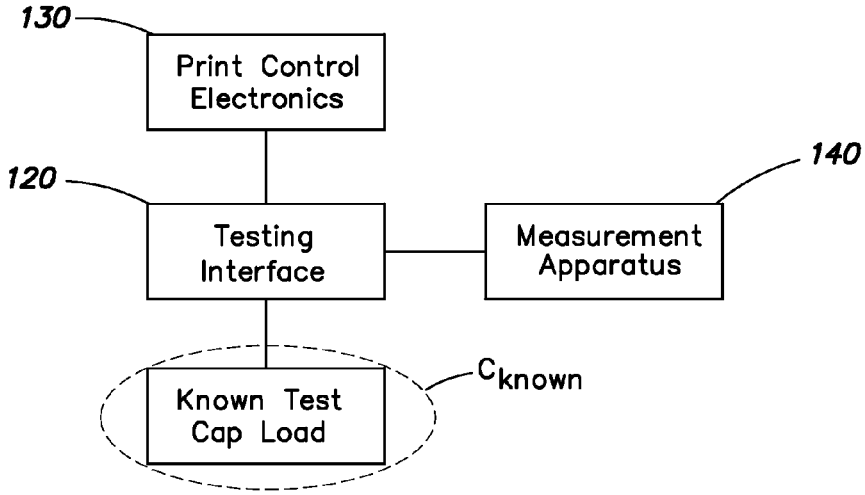
Figure 7C:
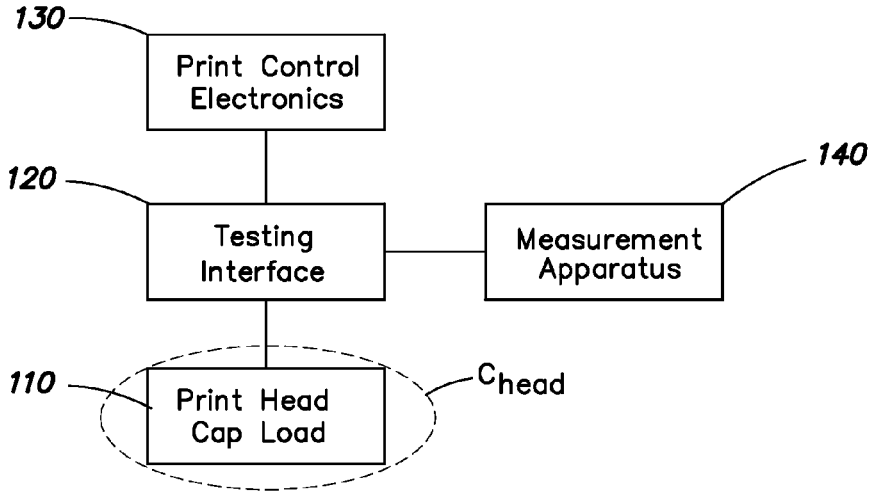

FIG. 6 is a flow chart showing an exemplary calibration method that may be used in step 403 of the reliability testing method discussed above. In operation, in step 603, the capacitance of the printer control electronics $C_{pce}$ and a test capacitance of known value $C_{known}$, which stands in as a substitute for the capacitive contribution of the print head, are directly measured once per channel using a capacitance meter, for example. FIGS. 7A, 7B and 7C schematically illustrate the (respective) capacitive contributions of: the printer control electronics ($C_{pce}$) and the combined contribution of the testing interface and measurement apparatus (together, $C_{test}$); the additional contribution from a known capacitive load ($C_{known}$); and the additional contribution from an unknown load from a print head substituted for the known load. In FIG. 7A, which depicts the capacitive contributions of the printer electronics ($C_{pce}$) and the testing channel ($C_{test}$) without a load, the total data acquisition capacitance $C_{DAQ}$ is defined as including both of these contributions, i.e., $C_{DAQ}=C_{test}+C_{pce}$.

In step 605 of the calibration process, a per-channel voltage reading is taken at the measurement apparatus in the state depicted in FIG. 7A, without the contribution of a load. In this case, the measured voltage at the measurement apparatus '$V_{no\text{-}load}$' can be expressed as:

$$V_{no\text{-}load}=I\cdot t/M(C_{DAQ}) \quad (3),$$

where M is a resistive attenuation factor equal to the ratio of R1 to R2 in the voltage compensator circuit.

In step 607, a per-channel voltage reading is taken at the measurement apparatus in the state depicted in FIG. 7B in which a known capacitive load is coupled to the testing interface. In this case, the measured voltage at the measurement apparatus '$V_{known\text{-}load}$' can be expressed as:

$$V_{known\text{-}load}=I\cdot t/M(C_{DAQ}+C_{known}) \quad (4).$$

In step 609, a per-channel voltage reading is taken at the measurement apparatus in the state depicted in FIG. 7C in which an unknown capacitive load (i.e., a print head) is coupled to the testing interface. In this case, the measured voltage at the measurement apparatus '$V_{unknown\text{-}load}$' can be expressed as:

$$V_{unknown\text{-}load}=I\cdot t/M(C_{DAQ}+C_{unknown}) \quad (5).$$

In step 611, the total data acquisition capacitance $C_{DAQ}$ is calculated using equations (3) and (4) above as follows:

$$C_{DAQ}=[(V_{no\text{-}load}/t)/(V_{known\text{-}load}/t)-1]*C_{known} \quad (6),$$

where $C_{DAQ}=C_{test}+C_{pce}$.

In step 613, the print head capacitance $C_{head}$ (or $C_{unknown}$) is calculated from the slew-rate ratios of $V_{known\text{-}load}$ to $V_{unknown\text{-}load}$ as follows:

$$(V_{known\text{-}load}/t)/(V_{unknown\text{-}load}/t)=(C_{DAQ}+C_{head})/(C_{DAQ}+C_{known}) \quad (7).$$

Since all variables other than $C_{head}$ are known or have been ascertained, $C_{head}$ can be determined numerically. This process can then be repeated over numerous channels to derive a calibrated relationship between $C_{head}$ and the measured value of unknown-load (V2).

It is again noted that the print head voltage signal can be reconstructed once $C_{head}$ is known. For example, when a print head channel is connected directly to the printer control electronics without the testing interface, the voltage signal $V_{head}$ can be expressed as:

$$V_{head}=I\cdot t/(C_{head}+C_{pce}) \quad (8)$$

Having calculated $C_{DAQ}$ and $C_{head}$, the actual fire pulse voltage signal for each print head channel ($V_{head}$) taking into account the effects of the testing interface can be reconstructed in step 615 using equation (8) as follows:

$$V_{head}/V_{unknown\text{-}load}=M*(C_{tot}/(C_{head}+C_{pce})) \quad (9),$$

where $C_{tot}=C_{DAQ}+C_{head}$.

Since all of the variables in equation (9) other than $V_{head}$ are known or have been ascertained, $V_{head}$ can be determined numerically.

The foregoing description discloses only particular embodiments of the invention; modifications of the above disclosed methods and apparatus which fall within the scope of the invention will be readily apparent to those of ordinary skill in the art.

Accordingly, while the present invention has been disclosed in connection with specific embodiments thereof, it should be understood that other embodiments may fall within the spirit and scope of the invention, as defined by the following claims.

The invention claimed is:

1. A system for reliability testing an inkjet printing system comprising:

a testing interface;

a print head coupled to the testing interface;

printer control electronics coupled to the testing interface and coupled to the print head via the testing interface, the printer control electronics adapted to transmit a firing voltage signal through the testing interface to the print head; and a measurement apparatus coupled to the testing interface;

wherein the testing interface includes an input path for receiving the firing voltage signal from the printer control electronics, the input path splitting into a first path coupled to the print head and a second path coupled to the measurement apparatus.

2. The system of claim 1, wherein the print head includes multiple channels that may each be individually activated and wherein the printer control electronics is adapted to transmit a firing voltage signal to each of the multiple channels of the print head.

3. The system of claim 2, wherein the testing interface includes a voltage compensator circuit for each print head channel, the voltage compensator circuit configured to adapt the firing voltage signal for output to the measurement apparatus.

4. The system of claim 3, wherein the voltage compensator circuit includes a resistive divider.

5. The system of claim 4, wherein the voltage compensator circuit includes series capacitors arranged in parallel to the resistive divider.

6. The system of claim 3, wherein the testing interface includes a selector circuit adapted to select one of the multiple print head channels for output to the measurement apparatus.

7. The apparatus of claim 1, wherein the testing interface and measurement apparatus comprise on-board components of the inkjet printing system.

8. The apparatus of claim 1, wherein the testing interface and measurement apparatus comprise off-board components.

9. An apparatus for testing an inkjet printing system comprising:

a test interface adapted to be coupled to a print head and to a print control circuit, wherein the print control circuit is coupled to the print head via the test interface and is adapted to transmit a firing signal through the test interface to the print head; and a measurement circuit coupled to the test interface;

wherein the test interface includes an input path for receiving the firing signal from the print control circuit, the input path being split into a first path coupled to the print head and a second path coupled to the measurement circuit.

10. The apparatus of claim 9, wherein the print head includes multiple channels that may each be individually activated and wherein the print control circuit is adapted to transmit a firing signal to each of the multiple channels of the print head.

11. The apparatus of claim 10, wherein the test interface includes a compensator circuit for each of the multiple channels, the compensator circuit configured to adapt the firing signal for output to the measurement circuit.

12. The apparatus of claim 11, wherein the compensator circuit includes a resistive divider.

13. The apparatus of claim 12, wherein the compensator circuit includes series capacitors arranged in parallel to the resistive divider.

14. The apparatus of claim 11, wherein the test interface includes a selector circuit adapted to select one of the multiple channels for output to the measurement circuit.

* * * * *